US009322090B2

(12) United States Patent
Goller et al.

(10) Patent No.: US 9,322,090 B2
(45) Date of Patent: Apr. 26, 2016

(54) COMPONENTS FORMED BY CONTROLLING GRAIN SIZE IN FORGED PRECIPITATION-STRENGTHENED ALLOYS

(71) Applicant: General Electric Company, Schenectady, NY (US)

(72) Inventors: George Albert Goller, Greenville, SC (US); Raymond Joseph Stonitsch, Simpsonville, SC (US); Richard DiDomizio, Scotia, NY (US)

(73) Assignee: General Electric Company, Schenectady, NY (US)

( * ) Notice: Subject to any disclaimer, the term of this patent is extended or adjusted under 35 U.S.C. 154(b) by 338 days.

(21) Appl. No.: 14/171,901

(22) Filed: Feb. 4, 2014

(65) Prior Publication Data

US 2015/0284832 A1 Oct. 8, 2015

Related U.S. Application Data

(62) Division of application No. 13/101,217, filed on May 5, 2011, now Pat. No. 8,679,269.

(51) Int. Cl.

| | |
|---|---|
| ***C22F 1/10*** | (2006.01) |
| ***C22C 38/00*** | (2006.01) |
| ***C22C 19/03*** | (2006.01) |
| ***C22C 19/05*** | (2006.01) |
| ***B22F 3/15*** | (2006.01) |
| ***B21J 1/06*** | (2006.01) |

(Continued)

(52) U.S. Cl.

CPC ... *C22F 1/10* (2013.01); *B21J 1/06* (2013.01); *B21K 1/32* (2013.01); *B22F 3/15* (2013.01); *B22F 3/17* (2013.01); *C22C 19/05* (2013.01); *C22C 19/055* (2013.01);

(Continued)

(58) Field of Classification Search

CPC ..... C22F 1/10; B22F 3/15; B21K 1/32; C22C 19/056; C22C 19/055; F01D 5/02; F01D 25/005

See application file for complete search history.

(56) References Cited

U.S. PATENT DOCUMENTS

| | | | |
|---|---|---|---|
| 4,957,567 | A | 9/1990 | Krueger et al. |
| 5,080,734 | A | 1/1992 | Krueger et al. |

(Continued)

FOREIGN PATENT DOCUMENTS

| | | | |
|---|---|---|---|
| CN | 1050743 | A | 4/1991 |
| CN | 1050744 | A | 4/1991 |

(Continued)

OTHER PUBLICATIONS

Unofficial English Translation of Chinese Office Action issued in connection with corresponding CN Application No. 201210205503.3 on May 26, 2015.

*Primary Examiner* — Jessee Roe

(74) *Attorney, Agent, or Firm* — Ernest G. Cusick; Frank A. Landgraff

(57) ABSTRACT

Components and methods of processing such components from precipitation-strengthened alloys so that the components exhibit desirable grain sizes following a supersolvus heat treatment. The method includes consolidating a powder of the alloy to form a billet having an average grain size. The billet is then forged at a temperature below the solvus temperature to form a forging having an average grain size of not coarser than the grain size of the billet. The billet is then forged at a total strain of at least 5%, after which at least a portion of the forging is heat treated at a temperature below the solvus temperature to pin grains within the portion. The entire forging can then be heat treated at a temperature above the solvus temperature of the alloy without coarsening the grains in the portion.

20 Claims, 1 Drawing Sheet

(51) Int. Cl.

| | |
|---|---|
| ***B21K 1/32*** | (2006.01) |
| ***B22F 3/17*** | (2006.01) |
| ***F01D 5/02*** | (2006.01) |
| ***F01D 25/00*** | (2006.01) |

(52) U.S. Cl.

CPC ..... *C22C 19/056* (2013.01); *F01D 5/02* (2013.01); *F01D 25/005* (2013.01); *B22F 2998/00* (2013.01); *B22F 2998/10* (2013.01); *F05D 2220/32* (2013.01); *F05D 2230/22* (2013.01); *F05D 2230/411* (2013.01); *F05D 2230/42* (2013.01)

(56) References Cited

U.S. PATENT DOCUMENTS

| | | | |
|---|---|---|---|
| 5,143,563 | A | 9/1992 | Krueger et al. |
| 5,547,523 | A | 8/1996 | Blankenship, Jr. et al. |
| 5,759,305 | A | 6/1998 | Benz et al. |
| 8,992,700 | B2 | 3/2015 | Bain et al. |
| 2009/0000706 | A1 | 1/2009 | Huron et al. |
| 2010/0329883 | A1 | 12/2010 | Mourer et al. |

FOREIGN PATENT DOCUMENTS

| | | | |
|---|---|---|---|
| CN | 101899595 | A | 12/2010 |
| CN | 101935780 | A | 1/2011 |

COMPONENTS FORMED BY CONTROLLING GRAIN SIZE IN FORGED PRECIPITATION-STRENGTHENED ALLOYS

CROSS REFERENCE TO RELATED APPLICATIONS

This is a division patent application of U.S. patent application Ser. No. 13/101,217, filed May 5, 2011, now U.S. Pat. No. 8,679,269.

BACKGROUND OF THE INVENTION

The present invention generally relates to methods for processing metal alloys. More particularly, this invention relates to a method for producing forged superalloy articles, in which fine grain sizes in the forged article can be retained following a supersolvus heat treatment, such that the articles are characterized by a microstructure with a desirable grain size.

Rotor components of land-based gas turbine engines used in the power generation industry are often formed of iron-based or nickel-based alloys. For certain advanced land-based gas turbine engines, such as the H and FB class gas turbines of the General Electric Company, rotor components are currently formed from gamma double-prime (γ") precipitation-strengthened nickel-based superalloys, such as Alloy 718 and Alloy 706. For example, wheels (disks) and spacers have been formed from cast ingots that are billetized and forged either above or below the solvus temperature of the alloy (typically in a range of about 1750 to about 2100° F. (about 954 to about 1150° C.)) to obtain the desired outline for the component. The best current processing practices typically result in relatively coarse-grained microstructures in the billet (for example, ASTM 00 or larger) as well as the finished forging (for example, ASTM 2 to 7) (reference throughout to ASTM grain sizes is in accordance with the standard scale established by the American Society for Testing and Materials). While coarse grains are desirable for certain regions/components, finer grains are often desirable for other regions/components. For example, while disks benefit from having relatively coarse grains at their rims to promote their resistance to creep and fatigue crack growth, their hubs (bores) benefit from finer grains to promote their resistance to low cycle fatigue (LCF) and burst properties.

Rotor components for aircraft gas turbine engines have often been formed by powder metallurgy (PM) processes, which are known to provide a good balance of creep, tensile and fatigue crack growth properties to meet the performance requirements of aircraft gas turbine engines. Typically, a powder metal component is produced by consolidating metal powders in some form, such as extrusion consolidation or hot isostatic pressing (HIP), to yield a fine-grained billet (for example, ASTM 8 or finer). The billet is then isothermally or hot die forged at a temperature slightly below the gamma-prime solvus temperature of the alloy to approach superplastic forming conditions, which allows the filling of the die cavity through the accumulation of high geometric strains without the accumulation of significant metallurgical strains. The forging process generally retains the fine grain size within the material while obtaining the desired outline for the component, after which a final heat treatment is performed before finish machining to complete the manufacturing process. Unlike advanced turbine systems for land-based gas turbine engines, PM rotor components for aircraft gas turbine engines have been typically formed from gamma prime (γ') precipitation-strengthened nickel-based superalloys with very high temperature and stress capabilities demanded by those parts. In order to improve creep resistance, fatigue crack growth resistance and other mechanical properties at elevated temperatures, the final heat treatment of these alloys may be performed above their gamma prime solvus temperature (generally referred to as supersolvus heat treatment) to cause significant coarsening of the grains. The desirability of achieving relatively coarse grains at the rim of a rotor disk and relatively finer grains within its hub is evidenced by U.S. Pat. No. 5,527,020 to Ganesh et al., which discloses a heat treatment process and apparatus for selectively heat treating the rim of a disk in order to cause grain growth in the disk while maintaining a finer grain structure in the hub.

The nickel-based superalloy rotors used in large electrical power generating turbines have generally not required the higher temperature gamma prime alloys nor this grain coarsening process to meet their mission and component mechanical property requirements, though it is foreseeable that such higher temperature alloys could be required at some future date to increase turbine efficiencies or increase component life.

During conventional manufacturing procedures involving hot forging operations, a wide range of local strains and strain rates may be introduced into the material that can cause non-uniform critical grain growth during post forging supersolvus heat treatment. Critical grain growth (CGG) as used herein refers to random localized excessive grain growth in an alloy that results in the formation of grains whose diameters exceed a desired grain size range for an article formed from the alloy. The presence of grains that significantly exceed a desired grain size range can significantly reduce the low cycle fatigue resistance of the article and can have a negative impact on other mechanical properties of the article, such as tensile and fatigue strength. U.S. Pat. No. 4,957,567 to Krueger et al. teaches a process for eliminating critical grain growth in fine grain nickel-based superalloy components by controlling the localized strain rates experienced during the hot forging operations. Krueger et al. teach that local strain rates must generally remain below a critical value to avoid critical grain growth. Further improvements in the control of final grain size have been achieved with the teachings of U.S. Pat. No. 5,529,643 to Yoon et al., which places an upper limit on the maximum strain rate gradient during forging, and U.S. Pat. No. 5,584,947 to Raymond et al., which teaches the importance of a maximum strain rate and chemistry control. For example, Raymond et al. teach an upper limit strain rate of below about 0.032 per second ($s^{-1}$) for the gamma prime nickel-based superalloy commercially known as René 88DT (U.S. Pat. No. 4,957,567). U.S. Published Patent Application No. 2009/0000706 to Huron et al. teaches that, by increasing the carbon content of René 88DT, strain rates of up to about 0.1 $s^{-1}$ are possible without critical grain growth.

The above efforts evidence the importance of grain size control in alloys used to form rotating components that are used in high temperature and high stress applications where resistance to creep and fatigue are critical. Controlling grain size along with the other mechanical properties of the alloys can have a direct effect on component life and cost. However, an ongoing challenge with components such as disks is the simultaneously desire to promote creep life with coarser grains and promote fatigue life with finer grains. As noted above, typical forgings produced from cast and wrought ingots typically have a relatively coarse final grain size (for example, ASTM 2 to 7), which are difficult to refine to form smaller grain sizes that are desired for the hub region of a rotor disk. On the other hand, forgings produced from PM billets yield much finer grain sizes (for example, ASTM 8 or finer), which then require a heat treatment capable of coarsening the grains in the rim without resulting in critical grain growth. Accordingly, significant challenges are encountered when attempting to achieve different grain sizes within a single forging.

BRIEF DESCRIPTION OF THE INVENTION

The present invention provides components and methods of processing such components from precipitation-strengthened alloys so that, following a supersolvus heat treatment, the components are characterized by grain sizes that, if desired, can differ in size within different regions of the alloy.

The method includes forming a powder of the metal alloy, and then consolidating the powder at a temperature below the solvus temperature of the alloy to form a billet having an average grain size. The billet is then forged at a temperature below the solvus temperature of the alloy to form a forging having an average grain size of not coarser than the average grain size of the billet. The billet is forged so as to achieve a total strain of at least 5%. At least a portion of the forging is then heat treated at a temperature below the solvus temperature of the alloy to pin grains within the portion. The forging can then be heat treated in its entirety at a temperature above the solvus temperature of the alloy to solution precipitates in the forging without coarsening the grains in the first portion. Following cooling of the forging, the average grain size within the portion of the forging is preferably within 1 or 2 ASTM sizes of the average grain size of the billet, and more preferably not coarser than the average grain size of the billet.

Another aspect of the invention is a forging, for example, a gas turbine engine disk, produced by a process comprising the steps described above.

A significant advantage of this invention is the ability to suppress grain growth within one or more regions of a forging during a subsequent supersolvus heat treatment to achieve significant control of the average grain size within those regions. In this manner, mechanical properties of the component produced from the forging, for example, creep resistance and fatigue crack growth resistance, can be achieved in certain regions of a forging as a result of having relatively large grains, while different mechanical properties, for example, low cycle fatigue resistance and burst strength, can be achieved in other regions of the forging. Such a capability is particularly beneficial in rotating hardware of gas turbine engines, for example, rotor disks of land-based and aircraft gas turbine engines.

Other aspects and advantages of this invention will be better appreciated from the following detailed description.

DETAILED DESCRIPTION OF THE INVENTION

Figures 1, 2, 3, 4:
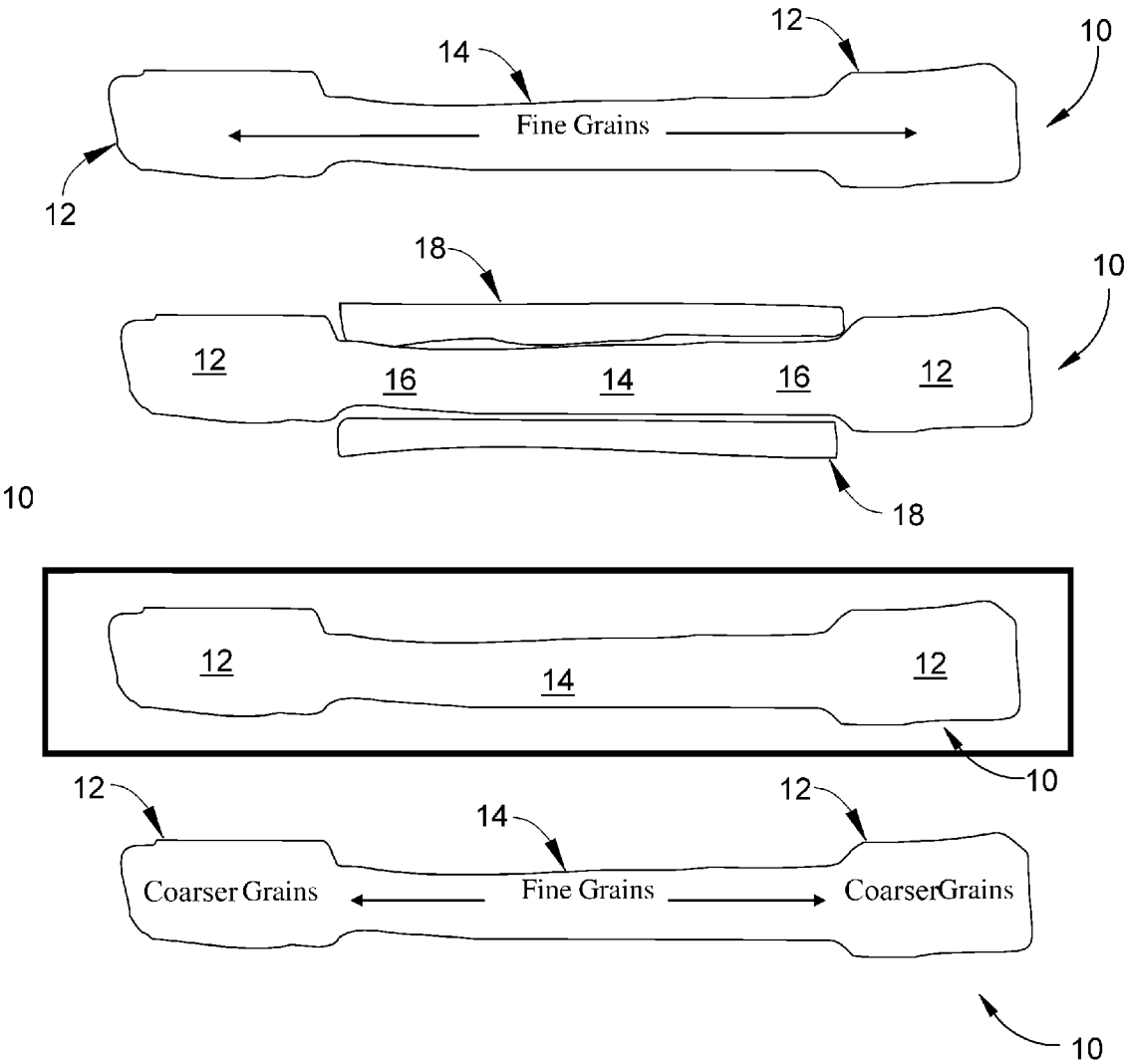
FIG. 1 schematically represents a forging of a type that can be processed in accordance with the present invention.
FIG. 2 schematically represents a heat treatment selectively performed on a limited portion of the forging of FIG. 1.
FIG. 3 schematically represents a heat treatment performed on the entire forging of FIGS. 1 and 2.
FIG. 4 schematically represents the forging resulting from the heat treatments depicted in FIGS. 2 and 3.

The invention generally encompasses processing that can be performed on a wide variety of alloys, and particularly alloys capable of being hardened/strengthened with precipitates. Particularly notable examples include gamma double-prime precipitation-strengthened nickel-based superalloys, in which nickel and niobium combine in the presence of iron to form a strengthening phase of body-centered tetragonal (bct) $Ni_3Nb$ precipitates in a gamma ($\gamma$) matrix containing nickel and one or more of chromium, molybdenum and iron. Other notable examples include gamma-prime precipitation-strengthened nickel-based superalloys, in which chromium, tungsten, molybdenum, rhenium and/or cobalt are principal alloying elements that combine with nickel to form the gamma matrix and aluminum, titanium, tantalum, niobium, and/or vanadium are principal alloying elements that combine with nickel to form a desirable strengthening phase of gamma-prime precipitate, principally $Ni_3(Al,Ti)$. The precipitates of these alloys can be solutioned (dissolved) by heating the alloys above their solvus (solutioning) temperature, and reprecipitated by an appropriate aging treatment performed below their solvus temperatures. These alloys can be forged to produce a variety of high-strength components having high temperature capabilities, including rotating components of land-based and aircraft gas turbine engines. Of particular interest to the invention are disks of land-based gas turbine engines, though the invention is not limited thereto.

The following describes a process for producing a turbine disk by forging alloys of the above-noted types to yield a finer (smaller) average grain size within its hub than in its rim, which circumferentially surrounds the hub. Finer grain sizes within the hub promote such properties as low cycle fatigue (LCF) resistance and burst strength, whereas coarser (larger) grain sizes within the rim promote its resistance to creep and fatigue crack growth. For purposes of a turbine disk of a land-based gas turbine engine formed of gamma double-prime precipitation-strengthened nickel-based superalloys, preferred average grain sizes for the hub are often not larger than ASTM 8, for example, ASTM 8 to 10 or finer, and preferred average grain sizes for the rim are often larger than ASTM 8, for example, ASTM 2 to 7 or larger. The present invention identifies processing parameters by which a desirable grain size distribution can be achieved in a precipitation-strengthened alloy, which may include improved control of the average grain sizes within certain regions of the alloy. According to one aspect of the invention, a finer average grain size can be achieved by performing a post-forging subsolvus heat treatment that serves to inhibit grain coarsening during a subsequent supersolvus heat treatment by providing a pinning effect on grain boundaries. Such an effect is preferably utilized with a fine-grained forging produced under forging parameters that include high total strains.

The above-noted aspects of the invention will be discussed in reference to FIGS. 1 through 4, which represent processing steps performed on a turbine disk of a land-based gas turbine engine. However, those skilled in the art will appreciate that the teachings and benefits of this invention are applicable to numerous other components.

The process initially involves the production of a fine-grained billet (not shown) of a precipitation-strengthened alloy, for example, a gamma double-prime precipitation-strengthened nickel-based superalloy. The billet preferably has fine grain size, more preferably an average grain size of ASTM 8 or finer, for example, ASTM 8 to about ASTM 10, and even as fine as ASTM 14 to 16. In addition to promoting superplasticity that is beneficial during the forging process, a fine grain size within the billet provides the basis for the fine-grained microstructure desired for the hub of the disk, as will become evident below. According to a preferred aspect of the invention, a fine-grained billet is produced by consolidating a powder, for example, by hot isostatic processing (HIP) or another known consolidation technique. A preferred powder production technique is a conventional argon atomization process, though other powder production techniques are possible and also within the scope of the invention. Furthermore, it may be possible to produce a fine-grained billet using other techniques, such as spraycast forming, cast and wrought, etc. In any event, the billet is formed under conditions, including a specified temperature range, to produce the desired fine grain size.

Hot isostatic pressing (HIP) is a preferred process for forming the billet to have an average grain size of about ASTM 8 or finer and achieve a density of 99% or more of theoretical. With this process, grain sizes of ASTM 14 to 16 have been achieved. Importantly, this step is performed at a temperature below the solvus temperature of the alloy to avoid grain growth and any solutioning of the precipitates. HIP is particularly well suited for this purpose because of the low strain rates that can be achieved with HIP at temperatures below solvus temperatures of precipitation-strengthened nickel-based alloys. Prior to forging the billet, a preheat step may be performed at a temperature below the solvus temperature of the alloy to avoid coarsening of the grains and a loss of the superplasticity advantageously achieved by the previous step. The billet is then forged (hot worked) at a temperature below the solvus temperature of the alloy to produce a forging having a suitable geometry (outline) for the disk, as well as retain an average grain size of about ASTM 8 or finer.

Whereas the prior art has sought to limit total strain during forging to avoid critical grain growth during subsequent heat treatments, the present invention seeks to ensure a sufficient total strain in the billet during forging. The total strain is at least 5%, more preferably at least 10% up to about 20%. Optimal strain levels are composition, microstructure, and temperature dependent, and can be determined for a given alloy by deforming test samples under various strain rate conditions, and then performing a suitable supersolvus heat treatment. Inadequate and excessive total strain levels are believed to result in the inability to control grain growth in critical areas of the forging. Suitable strain levels for regions within large forgings can be predicted analytically by performing experiments on small laboratory specimens, and then using modeling techniques to predict local deformation behavior within the forgings. Furthermore, suitable tooling and equipment for performing the forging operation are well known and therefore will not be discussed in any detail here.

In addition to the controlled total strain levels disclosed above, the forging operation is required to be performed below the solvus temperature of the alloy, in other words, at a subsolvus temperature, to avoid any solutioning of the precipitates and grain growth. Preferably, the alloy is maintained at a temperature of at least 5° C. below the solvus temperature of the alloy, and more preferably about 15 to about 35° C. below the solvus temperature.

FIG. 1 schematically represents a disk forging 10 processed in accordance with the above processing steps. The disk 10 is represented as comprising a rim 12 circumscribing a hub 14, in which a bore (not shown) will be subsequently defined for mounting the disk to a rotor shaft (not shown). Following the forging operation, the forging 10 undergoes a heat treatment at a subsolvus temperature. More preferably, to retain the fine grains within the hub 14 during a subsequent supersolvus (solution) heat treatment performed on the entire forging 10 (FIG. 3), only the portion of the forging 10 containing the hub 14 undergoes the subsolvus heat treatment, whereas the portion containing the rim 12 is maintained at a temperature below the solvus temperature of the alloy. For this purpose, FIG. 2 schematically represents a pair of heating elements 18 brought into proximity or contact with the hub 14 and optionally a web region 16 of the forging 10 between the rim 12 and hub 14. The heating elements 18 can be of any suitable type capable of selectively heating a region of the forging 10, for example, electrical heating elements. In some instances, it may be desirable to thermally insulate the rim 12 from the elements 18, and/or the rim 12 could be selectively cooled during this step.

As with the forging operation, the post-forging subsolvus heat treatment performed on the hub 12 is required to have a maximum temperature below the solvus temperature of the alloy to avoid grain growth and any solutioning of the precipitates. Preferably, the hub 14 is heated to a temperature of at least 50° C. below the solvus temperature of the alloy, and more preferably about 50 to about 120° C. below the solvus temperature. For gamma double-prime precipitation-strengthened nickel-based superalloys, a suitable range is believed to be about 1500 to about 1800° F. (about 815 to about 980° C.). Preferably, the hub 14 is held at the subsolvus temperature for about 2 to about 6 hours, and more preferably about 4 to about 6 hours. While not wishing to be held to any particular theory, the subsolvus heat treatment is believed to cause a pinning effect, in which the grain boundaries of the forging 10 are pinned and therefore inhibit grain growth during the subsequent supersolvus heat treatment (discussed below). It is believed that the pinning effect is the result of reducing the strain/dislocation energy at the fine grain boundaries so that there is not enough energy to cause grain growth during the supersolvus heat treatment.

From the point at which the powder was formed, the processing described above maintains the alloy at temperatures below its solvus temperature. At this time, the entire forging 10 preferably undergoes the supersolvus heat treatment by heating the entire forging 10 to at a temperature above the solvus temperature (but below the incipient melting temperature) of its alloy, as is schematically represented in FIG. 3. A suitable supersolvus temperature is typically about 15 to 30° C. above the solvus temperature of an alloy. For gamma double-prime precipitation-strengthened nickel-based superalloys, a suitable range for the supersolvus heat treatment is believed to be about 1900 to about 2000° F. (about 1040 to about 1090° C.). As known in the art, supersolvus heat treatments serve to dissolve (solution) precipitates within an alloy and recrystallize its grain structure. Though the entire forging 10 is subjected to the supersolvus heat treatment and precipitates within the hub 14 are also solutioned, only the grains within the rim 12 undergo grain growth during the present supersolvus heat treatment as a result of the grain-pinning effect within the hub 14 achieved with the preceding subsolvus heat treatment. The forging 10 is preferably held at the supersolvus temperature for a time sufficient for all of the constituents of the alloy to enter into solution, for example, about 4 to about 6 hours. The temperature and duration of the supersolvus heat treatment preferably results in sufficient grain growth (coarsening) within the rim 12 to achieve grain sizes of larger than ASTM 8, for example, ASTM 2 to 7 or larger. In contrast, grain sizes within the hub 14 preferably do not undergo coarsening and therefore are within preferably 1 or 2 ASTM sizes of the average grain size of the billet, and more preferably at least as fine as the grains in the as-forged forging 10 (FIG. 1), for example, ASTM 8 or finer and more preferably ASTM 8 to 10.

Following the supersolvus heat treatment, the forging 10 is cooled at an appropriate rate to re-precipitate the precipitates within the gamma matrix or at grain boundaries, so as to achieve the particular mechanical properties desired for the disk. Examples of suitable cooling steps include controlled air cooling alone or followed by quenching in oil or another suitable medium. The forging 10 may also be aged using known techniques, for example, using a short stress relief cycle at a temperature above the aging temperature of the alloy, if desirable to reduce residual stresses and form precipitates. At the completion of all thermal processing of the forging 10 (FIG. 4), larger (coarser) grains are present in the rim 12 as a result of the supersolvus heat treatment, whereas the fine grains originally present in the billet and forging 10 are preferably retained within the hub 14 as a result of the grain-pinning subsolvus heat treatment of this invention. The forging 10 can then undergo conventional machining to obtain the dimensions and other features required of the disk.

In an investigation leading to the present invention, PM billets were formed of the alloy ARA725. This alloy is reported to contain, by weight, about 17 to about 23% chromium, about 6 to about 8% molybdenum, about 3 to about 4% niobium, about 4 to about 6% iron, about 0.3 to about 0.6% aluminum, about 1 to about 1.8% titanium, about 0.002 to about 0.004% boron, about 0.35% maximum manganese, about 0.2% maximum silicon, about 0.03% maximum carbon, the balance nickel and incidental impurities. The actual chemistry of the billet was, by weight, about 20% chromium, about 7.5% molybdenum, about 3.5% niobium, about 5.0% iron, about 0.5% aluminum, about 1.5% titanium, about 0.003% boron, about 0.30% manganese, about 0.10% silicon, about 0.02% carbon, and the balance nickel and incidental impurities. The billet had an average grain size of finer than ASTM 10, and was forged at a temperature of about 1010° C., at a nominal strain level of about 10%. The alloy is believed to have had a solvus temperature of about 1030° C.

A portion of the resulting forging was then subjected to a subsolvus heat treatment at a temperature of about 900° C. for a duration of about 4 hours, while the remainder of the forging was not subjected to the heat treatment. Thereafter, the entire forging was subjected to a supersolvus heat treatment at a temperature of about 1050° C. for a duration of about 4 hours. On examination, the portion of the forging that did not undergo the subsolvus heat treatment was determined to have undergone coarsening of its grain structure, with an average grain size of about ASTM 2 to 7. On the other hand, the portion of the forging that had been subjected to the subsolvus heat treatment was determined to have substantially retained the grain structure of the billet and forging, and had an average grain size of about ASTM 8 or finer.

It should be noted here that, while the subsolvus heat treatment was selectively performed on the forging to inhibit grain growth in a limited portion of the forging, it is foreseeable that the entire forging could have undergone the subsolvus heat treatment, in which case grain growth would have been inhibited throughout the forging. By doing so, the entire forging 10 would have a fine grain size and exhibit similar fatigue properties throughout.

While the invention has been described in terms of particular embodiments, it is apparent that other forms could be adopted by one skilled in the art, including the use of other precipitation-strengthened alloys, or by modifying the disclosed method such as substituting processing steps or including additional processing steps. Accordingly, the scope of our invention is to be limited only by the following claims.

The invention claimed is:

1. An article having first and second portions, the article being produced by a method comprising:

forming a powder of a precipitation-strengthened iron-based or nickel-based superalloy having a solvus temperature consolidating the powder at a temperature below the solvus temperature of the superalloy to form a billet having an average grain size;

forging the billet at a temperature below the solvus temperature of the superalloy to form a forging comprising the first and second portions of the article, the forging having an average grain size of not coarser than the average grain size of the billet, the billet being forged so as to achieve a total strain of at least 5%;

heat treating at least the first portion of the forging, but not the second portion of the forging, at a temperature below the solvus temperature of the superalloy to pin grains within the first portion;

heat treating the forging in its entirety at a temperature above the solvus temperature of the superalloy to solution precipitates in the forging without coarsening the grains in the first portion, wherein grains in the second portion are coarsened to an average grain size of coarser than the average grain size of the billet; and cooling the forging, wherein the average grain size within the first portion is within 1 or 2 ASTM sizes of the average grain size of the billet.

2. The article according to claim 1, further comprising precipitates in the article.

3. The article according to claim 1, wherein the grains in the first portion have an average grain size of ASTM 8 or finer.

4. The article according to claim 1, wherein the grains in the second portion have an average grain size of ASTM 2 to 7.

5. The article according to claim 1, wherein the article is a component formed by machining the forging after the cooling step.

6. The article according to claim 5, wherein the component is a rotating component of a gas turbine engine.

7. The article according to claim 6, wherein the rotating component is a disk of a land-based gas turbine engine.

8. The article according to claim 1, wherein the superalloy is a nickel-based superalloy.

9. The article according to claim 1, wherein the superalloy is a gamma-prime precipitation-strengthened nickel-based superalloy.

10. The article according to claim 9, wherein the article is a component formed by machining the forging after the cooling step.

11. The article according to claim 10, wherein the component is a rotating component of a gas turbine engine.

12. The article according to claim 11, wherein the rotating component is a disk of a land-based gas turbine engine.

13. The article according to claim 1, wherein the superalloy is a gamma double-prime precipitation-strengthened nickel-based superalloy.

14. The article according to claim 13, wherein the article is a component formed by machining the forging after the cooling step.

15. The article according to claim 14, wherein the component is a rotating component of a gas turbine engine.

16. The article according to claim 15, wherein the rotating component is a disk of a land-based gas turbine engine.

17. The article according to claim 13, wherein the article contains $Ni_3Nb$ precipitates and the superalloy consists of, by weight, about 17 to about 23% chromium, about 6 to about 8% molybdenum, about 3 to about 4% niobium, about 4 to about 6% iron, about 0.3 to about 0.6% aluminum, about 1 to about 1.8% titanium, about 0.002 to about 0.004% boron, about 0.35% maximum manganese, about 0.2% maximum silicon, about 0.03% maximum carbon, the balance nickel and incidental impurities.

18. A disk for a land-based gas turbine engine, the disk having a rim portion and a hub portion and being produced by a method comprising:

forming a powder of a precipitation-strengthened nickel-based superalloy having a solvus temperature;

hot isostatic pressing the powder at a temperature below the solvus temperature of the superalloy to form a billet having an average grain size of ASTM 8 or finer and a density of at least 99% of theoretical;

forging the billet at a temperature below the solvus temperature of the superalloy to form a forging having an average grain size of ASTM 8 or finer, the billet being forged so as to achieve a total strain of at least 5%;

heat treating a hub portion of the forging but not a rim portion of the forging, the heat treating being performed at a temperature below the solvus temperature of the superalloy to pin grains within the hub portion to an average grain size of ASTM 8 or finer;

heat treating the forging in its entirety at a temperature above the solvus temperature of the superalloy to solution precipitates in the forging, the grains in the rim portion being coarsened to an average grain size of coarser than ASTM 8 and the grains in the hub portion having an average grain size of ASTM 8 or finer;

aging the forging to form precipitates in the forging;

cooling the forging, wherein the average grain size within the hub portion is ASTM 8 or finer and the average grain size within the second portion is ASTM 2 to 7; and machining the forging to produce the disk.

19. The disk according to claim 18, wherein the superalloy is a gamma double-prime precipitation-strengthened nickel-based superalloy.

20. The disk according to claim 18, wherein the gamma double-prime precipitation-strengthened nickel-based superalloy consists of, by weight, about 17 to about 23% chromium, about 6 to about 8% molybdenum, about 3 to about 4% niobium, about 4 to about 6% iron, about 0.3 to about 0.6% aluminum, about 1 to about 1.8% titanium, about 0.002 to about 0.004% boron, about 0.35% maximum manganese, about 0.2% maximum silicon, about 0.03% maximum carbon, the balance nickel and incidental impurities.

* * * * *